United States Patent [19]

Bseisu

[11] Patent Number: 4,992,997

[45] Date of Patent: Feb. 12, 1991

[54] STRESS WAVE TELEMETRY SYSTEM FOR DRILLSTEMS AND TUBING STRINGS

[75] Inventor: Amjad A. Bseisu, Dallas, Tex.

[73] Assignee: Atlantic Richfield Company, Los Angeles, Calif.

[21] Appl. No.: 188,231

[22] Filed: Apr. 29, 1988

[51] Int. Cl.[5] ..... G01V 1/40

[52] U.S. Cl. ..... 367/82; 181/106

[58] Field of Search ..... 367/82; 181/106; 175/40, 45–50

[56] References Cited

U.S. PATENT DOCUMENTS

| | | | |
|---|---|---|---|
| 3,185,250 | 5/1965 | Alazier | 181/121 |
| 3,244,252 | 4/1966 | Burns | 181/121 |
| 3,790,930 | 2/1974 | Lamel et al. . | |
| 3,930,220 | 12/1975 | Shawhan | 175/50 |
| 4,001,773 | 1/1977 | Lamel et al. . | |
| 4,071,086 | 1/1978 | Bennett | 166/177 |
| 4,139,836 | 2/1979 | Chaney et al. . | |
| 4,156,229 | 5/1979 | Shawhan . | |
| 4,207,961 | 6/1980 | Kitsunezaki | 181/106 |
| 4,222,455 | 9/1980 | Lerwill | 181/121 |
| 4,314,365 | 2/1982 | Petersen et al. | 367/82 |
| 4,327,814 | 5/1982 | Erich | 181/121 |
| 4,562,559 | 12/1985 | Sharp et al. | 367/82 |
| 4,597,067 | 6/1986 | Bockhorst et al. | 175/40 |
| 4,709,362 | 11/1987 | Cole | 367/189 |
| 4,715,451 | 12/1987 | Bseisu et al. | 175/40 |

OTHER PUBLICATIONS

Barnes, "Passbands for Acoustic Transmission . . . ", Jour. Acoust. Soc. Am., vol. 51, #5, Pt. 2, pp. 1606–1608, 1972.

Squire et al., "A New Approach to Drill-String . . . ", 9/26/79, 54th Annu. Fall Tech. Conf. of AIME, 8 pp.

*Primary Examiner*—Nelson Moskowitz

*Attorney, Agent, or Firm*—Michael E. Martin

[57] ABSTRACT

Downhole conditions in wellbores such as fluid pressure, temperature and flow conditions during drillstem testing or during wellbore stimulation or fracturing processes are transmitted through sensing and signal conversion circuits to axial or torsional wave vibrators secured to a drillstem or tubing string in the borehole for generating stress wave vibrations in the drillstem or tubing string for transmission to a point at or near the earth's surface. Accelerometers and/or strain gauges are mounted on the stem or tubing at a point near the earth's surface for sensing the torsional, axial or bending vibrations and converting the vibratory signals to signals for receipt and recording and correlated with the signals being transmitted from the borehole. The system includes an axial compression wave generator comprising a solenoid energized oscillator hammer member disposed on a sub which may be interposed in the drillstem. A torsional wave vibration generator may be utilized comprising a sub having motor driven eccentric rotors which are driven in timed relationship to each other to generate selected torsional and/or bending stress waves in the drillstem or tubing string.

12 Claims, 3 Drawing Sheets

STRESS WAVE TELEMETRY SYSTEM FOR DRILLSTEMS AND TUBING STRINGS

BACKGROUND OF THE INVENTION

1. Field of the Invention

The present invention pertains to a telemetry system for communicating data related to parameters such as pressure, flow, temperature and other parameters in a wellbore through a drill stem or tubing string by generating stress waves or controlled vibrations in the tubing string in the wellbore and sensing the vibrations with strain gauges and/or accelerometers disposed on the tubing string at or near the surface.

2. Background

A problem of longstanding in the art of drilling, completing and servicing -oil and gas wells is the transmission of information from deep in the wellbore to the surface, such information including pressure, temperature, fluid flow rate, and other parameters desired to be measured at a particular point in the wellbore. During drilling operations it is also desired to be able to determine the actual weight on the drill bit, stresses in the drillstem and bit, bit rotational speed and related parameters.

In regard to transmitting data while drilling, various types of so-called telemetry systems have been developed including mud pulse type systems, electromagnetic systems and acoustic wave transmission systems. Certain shortcomings have been recognized in all of these systems with respect to the quality of the signal received at the surface. However, in pursuing the invention in my U.S. Pat. No. 4,715,451, assigned to the assignee of the present invention, it has been recognized that axial, torsional, and bending vibrations of a drillstem or tubing string at various frequencies and intensities can be sensed at a point at or near the surface with the utilization of high resolution strain gauges and accelerometers suitably mounted on the drillstem or tubing string. Based on experimentation and the development of measuring drillstem and tubing string loading and behavior utilizing the method and apparatus described in the above-mentioned patent, an improved telemetry system has been developed in accordance with the present invention which overcomes the shortcomings of prior art systems and is believed to be suitable for use in drillstems, tubing strings and other elongated tubing members oriented in a borehole and extending to depths of several thousand feet or on the surface along generally horizontal runs or courses, also over distances of at least several thousand feet.

SUMMARY OF THE INVENTION

The present invention provides an improved telemetry system and method for transmitting signals from a designated point in a drillstem or tubing string by generating controlled vibrations or stress waves in the tubing string which are transmitted along the tubing string and are sensed by means which convert the vibrations to usable data.

In accordance with one aspect of the present invention, there is provided a downhole vibration or stress wave generator which is controlled to operate at various frequencies or frequency phase shifts for transmitting vibrations along a drillstem or tubing string toward the end disposed at the surface. The vibration generator is preferably of a continuous vibration or wave generating type which is controlled to transmit a signal related to a selected one of parameters to be measured downhole such as fluid pressure, temperature, fluid flow rates and related information.

In accordance with another aspect of the present invention, there is provided means disposed at or near the surface for sensing the vibrations of the drillstem or tubing string and for generating signals related to such vibrations for transmission to a signal receiving and recording device whereby usable data related to the parameters to be measured may be obtained.

In accordance with still another aspect of the present invention, there is provided a data telemetry system characterized by one or more downhole members or subs which include sensing devices, signal conversion devices and preferably a microprocessor or computer for data storage and manipulation and for controlling the excitation of a vibrator, shaker or exciter apparatus generating controlled vibrations or stress waves for transmission along a tubular stem or string for receipt by vibration sensing devices connected to the tubing string and located at or near the surface. One embodiment of the invention contemplates the provision of a torsional and bending stress wave generator and another embodiment of the invention contemplates the provision of an axial stress wave generator or exciter.

The superior features and advantages of the invention described hereinabove as well as other aspects thereof will be further appreciated by those skilled in the art upon reading the detailed description which follows in conjunction with the drawing.

DESCRIPTION OF PREFERRED EMBODIMENTS

Figure 1:
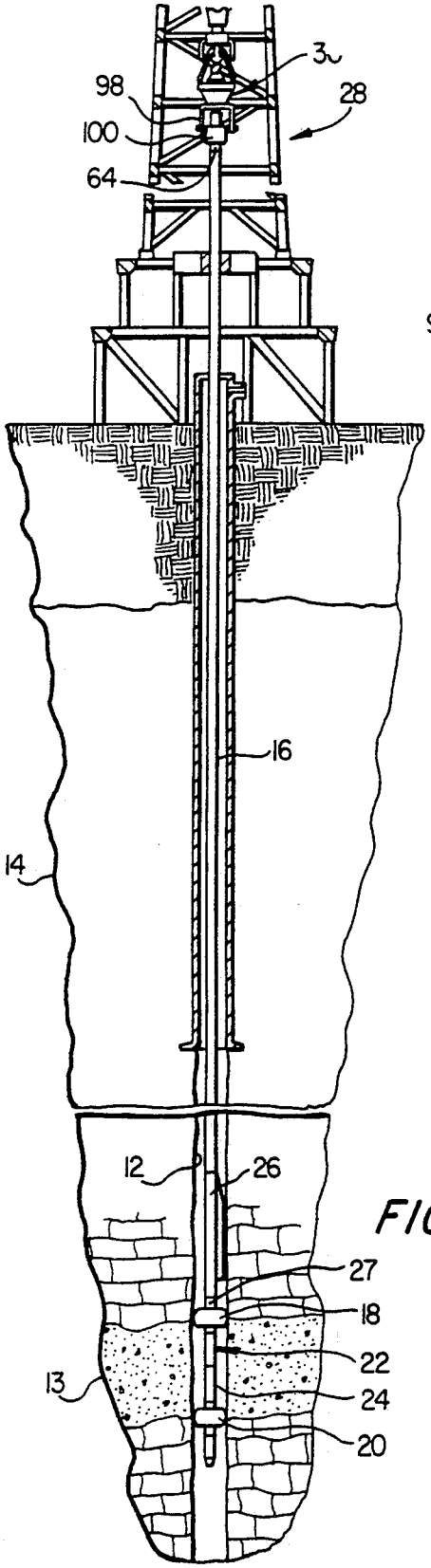
FIG. 1 is a vertical section view in somewhat schematic form of a system for telemetering downhole data through a drillstem during a drillstem testing operation.

In the description which follows, like parts are marked throughout the specification and drawing with the same reference numerals, respectively. The drawing figures are not necessarily to scale and certain features are shown in schematic form or in generalized form in the interest of clarity and conciseness.

The present invention contemplates the provision of a telemetry system particularly adapted for use in conjunction with drillstems during drillstem testing operations, for example, and in wellbore tubing strings for use during various well completion, servicing or stimulation operations. It has been determined that stress waves may be transmitted along elongated steel pipe or tubing strings as either axial compressional waves, which, in steel, have a velocity in the range of about 16,000 feet per second, or as torsional waves which have a velocity in the range of about 10,000 feet per second. By propagating these waves at selected frequencies or through phase shift keying along the drillstem or tubing string suitable signal transmission may be carried out from relatively deep locations in wellbores to or near the surface and sensed by accelerometers and strain gauges of a suitable type mounted on the drillstem or tubing string. The arrangement of accelerometers and strain gauges may be similar to those described in U.S. Pat. No. 4,715,451. The carrier signal transmitted along the drillstem or tubing string may be digitized and modulated by frequency or by phase shifting to indicate the binary states.

Referring to FIG. 1, for example, there is illustrated a wellbore 12 which has been drilled into an earth formation 14 and is prepared for so-called drillstem testing of a certain portion of the formation such as the region 13. In accordance with the general procedure in drillstem testing, an elongated drillstem or tubing string 16 is lowered into the wellbore 12 and having connected thereto suitable spaced apart packers 18 and 20 which are operated to pack off the portion of the wellbore 12 that penetrates the region 13. When the formation conditions existing in the region 13 are to be tested suitable subs 22 and 24 are interposed in the drill string 16 between the packers 18 and 20 and a third sub 26 is interposed in the drill string uphole of the packer 18. The drillstem 16 extends to a conventional drilling rig 28 and is suspended from a suitable swivel 30 in a conventional manner. The swivel 30 may be adapted to rotate the drillstem in a so-called top drive arrangement or the drillstem may be rotated during normal operation by a conventional rotary table drive 32. During the drillstem testing operation the drillstem 16 is not normally rotated substantially but only as required to operate certain apparatus associated with the testing functions. For example, the sub 24 may include suitable test ports for admitting wellbore fluid into the interior of the drillstem to be measured by certain sensor elements disposed in the sub 22. Various combinations of commercially available drillstem components utilized in drillstem testing operations may be incorporated in the sub 24 or otherwise interposed in the drillstem between the packers 18 and 20.

Figure 3:
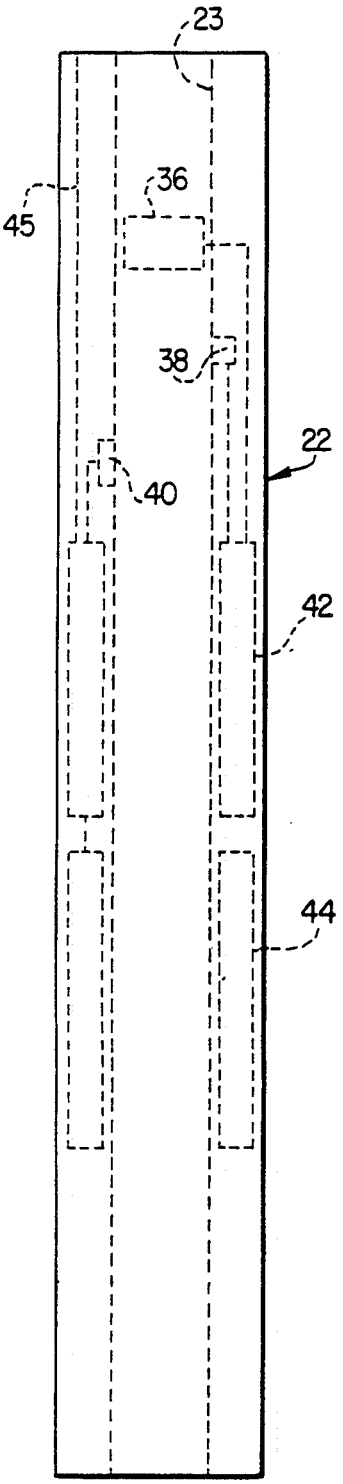
FIG. 3 is an elevation of a sub including sensing devices, signal converting electronics and related apparatus for the system of the present invention.

For the sake of discussion in connection with the present invention, the sub 22 may include certain sensing elements, an electrical energy source, conversion electronic circuits and a data acquisition and manipulation unit or computer. For example, referring to FIG. 3 the sub 22 is illustrated as including a central passage 23 extending therethrough for receiving fluid from the wellbore or, alternatively, from the drillstem. Suitable sensing elements such as a flowmeter 36, a pressure sensor 38, and a temperature sensor 40 are disposed on the sub 22 and suitably connected to electrical circuit means 42 for receiving the signals generated by the sensors and for converting the signals to a digital format for storage and manipulation by a suitable processor 44. The circuit means 42 and processor 44 are suitably disposed in an annular cavity formed in the sub 22 and isolated from the passage 23. Digital signals output from the processor 44 are transmitted to an intermediate sub 27, FIGS. 1 and 4, disposed in the drillstem below the sub 26.

Figure 4:
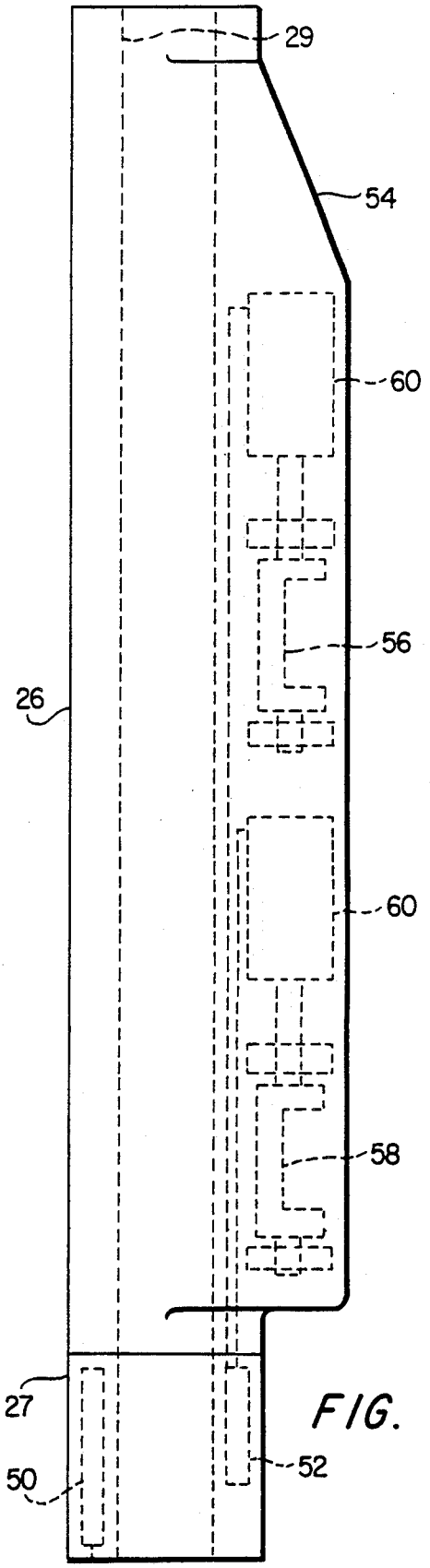
FIG. 4 is an elevation showing one embodiment of a stress wave generator or exciter in accordance with the present invention.

Referring now to FIG. 4, the sub 27 is adapted to include suitable control circuitry for operating a stress wave generator associated with the sub 26 which circuitry is generally designated by the numeral 50. The sub 27 may also include a source of electrical energy such as a battery pack 52, which may also be disposed in the sub 26, space permitting. The sub 26 is modified to include a side pocket portion 54 having an interior space isolated from an axial passage 29 and adapted for supporting a stress wave generator or vibrator means characterized by spaced apart motor driven rotating eccentric members 56 and 58. Each of the rotor members 56 and 58 may be suitably driven by a rotary DC type brushless electric motor 60 which may be precisely and separately controlled to rotate the members 56 and 58, respectively, upon command from the control circuitry 50. By timing the rotational speed and phase relationship of the rotating members 56 and 58, certain torsional stress waves may be induced in the sub 26 and the drillstem 16 for propagation therealong to the surface and to a sub 64, FIG. 2, connected to the swivel 30. The axial spacing of the rotor members 56 and 58 also provides for inducing bending stresses in the drillstem 16 depending on the phase relationship and the spacing of the members 56 and 58. The particular arrangement of the components of the subs 26 and 27 permits the inclusion therein of the axial passageway 29 for the throughput of fluids, if desired.

Figure 2:
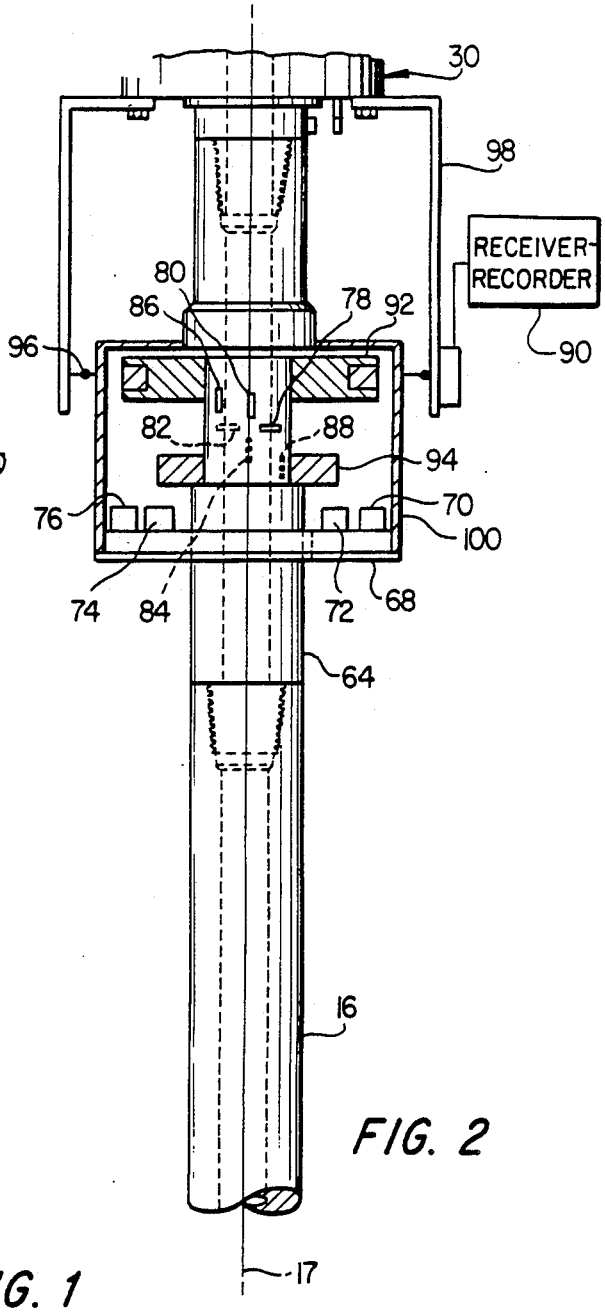
FIG. 2 is a detail elevation of the upper end of the drillstem illustrated in FIG. 1 showing the arrangement of the stress wave or vibration measuring strain gauges/and accelerometers.

Referring further to FIG. 2, the sub 64 is characterized by a transverse hub portion 68 which serves as a platform for supporting a plurality of high resolution accelerometers generally of the type described in U.S. Pat. No. 4,715,451. The accelerometers, designated by the numerals 70, 72, 74 and 76 are arranged such that their sensitive axes measure torsional and axial or bending vibrations of the drillstem 16. For example, the accelerometers 72 and 74 are arranged to sense motion in a plane normal to the axis 17 of the drillstem 16 and tangentially with respect to the axis. The accelerometers 70 and 72 are arranged to sense motion along the axis 17 in opposite directions and thus are also capable of sensing a bending vibration imposed on the sub 64. Axial and torsional stress waves being propagated along the drillstem 16 may also be sensed by an arrangement of strain gauges 78, 80, 82 and 84 similar to that described in the above-mentioned patent. Surface waves propagated along the drillstem 16 may be sensed by strain gauges 86 and 88. The signals from the strain gauges and accelerometers described above may be transmitted through suitable conductors to a receiver and recorder 90 or other suitable signal receiving and treating device if the drillstem is not required to be rotated. However, if the drillstem 16 is adapted for rotation during the drillstem testing operation or during other operations while stress waves are being transmitted from the sub 26, it is preferable to transmit signals to the receiver-recorder 90 by way of a radio link including a transmitter 92 which is supplied with power from a battery pack 94. A suitable circular receiving antenna 96 is supported in proximity to the transmitter 92 by a depending bracket 98 supported by the swivel 30. A suitable cover 100 is disposed over the devices mounted on the plate 68 and the sub 64.

The operation of the stress wave telemetry system illustrated in FIGS. 1 through 4 is believed to be understandable from the foregoing description, however, when it is desired to perform a drillstem test of the formation region 13 the drillstem 16 is made up to include the packers 18 and 20, and the subs 22, 24, 26 and 27. This drillstem configuration is then lowered into the wellbore 12 in a conventional manner using the drilling rig 28 and including the sub 64 interposed between the swivel 30 and the remainder of the drillstem. The sub 64 may, of course, be left connected to the swivel 30 during other operations such as contemplated by U.S. Pat. No. 4,715,451. When the drillstem 16 has been installed and the packers 18 and 20 set a formation test may be conducted by allowing the flow of fluid through at least the sub 22 through suitable admission ports in the sub 24, not shown. Fluid flow, pressure and temperature values are then sensed, converted to digitized form and either stored or transmitted to the control circuit 52 for operation of the vibrator means represented by the motor driven eccentric rotors 56 and 58 so that torsional vibrations, for example, can be transmitted through the drill string 16 at selected frequencies for sensing by the accelerometers 72 and 74, for example. If bending vibrations are induced in the drillstem through operation of the exciter or vibrator the accelerometers 70 and 76 are capable of sensing these bending vibrations and providing an output signal to the receiver-recorder 90 through the radio transmission link, for example.

Through experimentation with the transmission of vibrations in conventional steel drillstems and surface pipelines, it has been determined that for frequencies up to about 100 hz attenuation factors are near 1.0 (essentially no attenuation) and excellent correlations between transmission and receipt have been experienced for frequencies around 20 hz to 30 hz. It is contemplated that tubing strings or drillstems as long as 30,000 feet may be capable of transmitting data in this manner.

Figure 5:
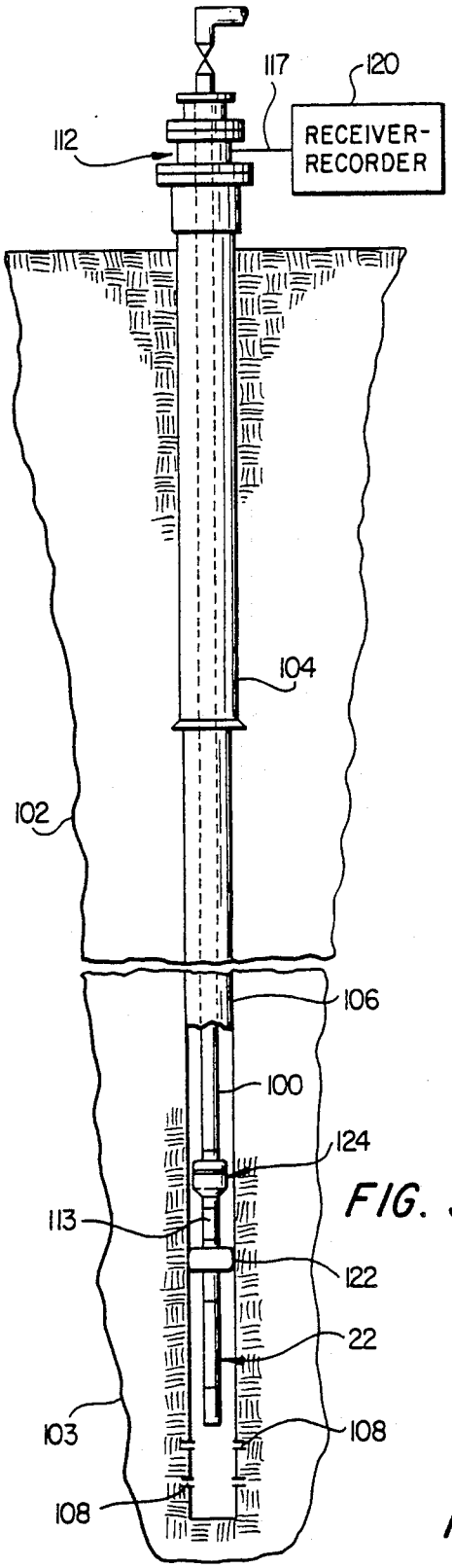
FIG. 5 is a vertical section view in somewhat schematic form of a tubing string equipped with an alternate embodiment of the stress wave telemetry system of the present invention.
Figure 6:
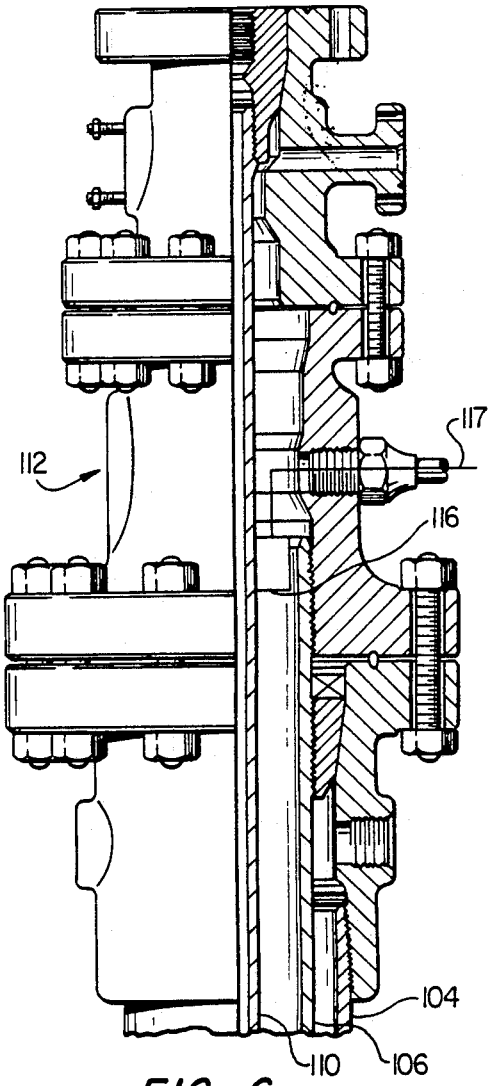
FIG. 6 is a detail view of a wellhead such as that shown in FIG. 5 showing an axial compression wave sensing accelerometer.
Figure 7:
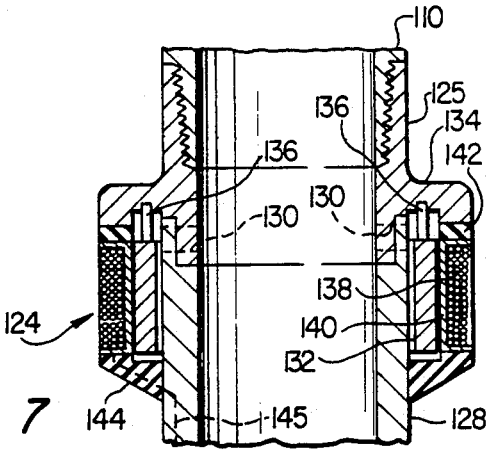
FIG. 7 is a section view of an axial compressional stress wave generator in accordance with the present invention.

Referring now to FIGS. 5 through 7, there is illustrated in FIG. 5 an alternate embodiment of the present invention for installation in tubing strings disposed in a wellbore for various operations such as the injection of fluids during fracturing of a formation. As shown in FIG. 5, an earth formation 102 has been penetrated by a wellbore having surface casing 104 and bottom casing 106 set therein. The wellbore has been prepared for injection of fracturing fluids or stimulation fluids through perforations 108 into the wellbore region 103 by way of an elongated tubing string 110 extending within the casings 104 and 106. The tubing string 110 as well as the casings 104 and 106 terminates in a conventional wellhead 112, see FIG. 6 also, and the upper end of the tubing string has mounted thereon an accelerometer 116 adapted for measuring vibrations which propagate axially along the tubing string in the form of a compressional wave. The accelerometer 116 includes a conductor 117 which transmits an output signal to a receiver-recorder 120 similar to the receiver-recorder 90.

Referring further to FIG. 5, the tubing string 110 includes a suitable packer 122 for sealing off the portion of the wellbore into which fracturing or stimulation fluids are injected for flow through the perforations 108. Typically, the sub 22 or a similar sub, including suitable sensors, is interposed in the tubing string and adapted to include means for energizing a compression wave generator or vibrator 124 also interposed in the tubing string, preferably above the packer 122.

Referring to FIG. 7, one embodiment of a compression wave generator or vibrator means is illustrated which may be constructed as a part of a sub 125 interposed in the tubing string 110. The vibrator 124 includes the sub 125 and a tubular section 128 which are secured together at a pinned joint including a plurality of transverse pin members 130 which are adapted to secure the two members 125 and 128 together but allow slight bending movement of the sub 125 relative to the sub 128. An annular member 132 formed of magnetic material is disposed around the member 128 and is secured to a peripheral flange 134 of the member 125 by a plurality of circumferentially spaced axially extending pins or rods 136. A solenoid coil 138 is disposed on a nonmagnetic spool 140 and encapsulated in a suitable sealant and around the exciter member 132. Suitable resilient seal members 142 and 144 are also bound to the coil and to the members 125 and 128, respectively.

When the coil 138 is energized by current of reversing polarity at a selected frequency, the member 132 is axially oscillated at a corresponding frequency. In this way, axial vibrations are transmitted to the flange 134 and axially through the tubing string 110 as a compression wave at the selected frequency. The solenoid coil 138 is connected to a suitable source of energy at a selected frequency by conductor means 145 for excitation at a frequency corresponding to a selected datapoint or data set to be transmitted through the tubing string 110 to the accelerometer 116.

A sub 113, FIG. 5, is preferably interposed in the tubing string between the sub 22 and the vibrator 124 and includes a suitable electrical energy source, not shown, for exciting the vibrator, and a controlling circuit, also not shown, which may be similar to the circuit 52 for controlling the torsional vibrators in the sub 26. The sub 113 may also be adapted to include an onboard signal processing unit for storing and manipulating the digital data received from the sub 22. Accordingly, the system illustrated in FIGS. 5, 6 and 7 is operable also to transmit data through the tubing string using stress wave propagation, the primary difference being that in the embodiment of FIG. 5 the stress waves are axial compressional waves as compared with the torsional and bending waves used as the transmission signal of the system illustrated in FIGS. 1 through 4. Depending on the specific configuration of the tubing string, other types of vibrators or exciters may be utilized for generating either axial compression waves or torsional waves.

The operation of the embodiment of the stress wave telemetry system described in conjunction with FIG. 5 is also believed to be understandable to those of skill in the art from the foregoing description. Although preferred embodiments of a method and system in accordance with the present invention have been described herein, those skilled in the art will also recognize that various substitutions and modifications may be made without departing from the scope and spirit of the invention as recited in the appended claims.

What is claimed is:

1. A system for transmitting signals along one of an elongated tubular drillstem and tubing string between a point in a wellbore and a point at or near the earth's surface, said system comprising:

an elongated tubular stem extending into a wellbore and supported by support means at the earth's surface;

means associated with said stem for sensing a condition in said wellbore related to wellbore operations;

means for converting signals related to said condition to a digital signal;

means interposed in said stem for generating a compressional wave at a selected frequency in said stem for transmission along said stem toward the earth's surface, said means for generating including a sub having a transverse flange, a generally annular member of magnetic material connected to said flange and disposed for oscillatory axial vibration for imparting compressional waves to said flange and to said stem, and a solenoid coil disposed in proximity to said annular member and adapted to be energized to oscillate said annular member at a selected oscillatory frequency for transmitting compressional stress waves along said stem; and means connected to said stem for sensing said vibrations and for transmitting signals related to said vibrations to receiving means at or near the earth's surface whereby information related to said condition in said well bore is transmitted to said receiving means through conversion of vibrations propagated along said stem.

2. A system for transmitting signals along one of an elongated tubular drillstem and tubing string between a point in a well bore and a point at or near the earth's surface, said system comprising:

an elongated tubular stem extending into a wellbore and supported by support means at the earth's surface;

means associated with said stem for sensing a condition in said wellbore related to wellbore operations;

means for converting signals related to said condition to a digital signal;

means interposed in said stem for generating torsional vibrations in said stem for transmission along said stem toward the earth's surface, said means for generated torsional vibrations comprising a sub and at least two unbalanced rotor members supported on said sub and connected to motor means and operable to be driven at selected speeds and in selected phase relationship to each other for generating torsional vibrations in said sub and said stem at selected frequencies, and means connected to said stem for sensing said vibrations and for transmitting signals related to said vibrations to receiving means at or near the earth's surface whereby information related to said condition in said wellbore is transmitted to said receiving means through conversion of vibrations propagated along said stem.

3. A system for transmitting signals along an elongated tubing string between first and second spaced apart points on said tubing string, said system comprising:

an elongated tubing string supported by support means;

vibrator means interposed in said tubing string for generating vibrations for transmission along said tubing string between said first and second points, said vibrator means including a sub having a transverse flange, a generally annular member of magnetic material connected to said flange and disposed for oscillatory axial vibration for imparting compressional waves to said flange and to said tubing string, and a solenoid coil disposed in proximity to said annular member and adapted to be energized to oscillate said annular member at a selected oscillatory frequency for transmitting compressional stress waves along said tubing string;

means for exciting said vibrator means to produce oscillatory vibrations for propagation along said tubing string between said first and second points;

means connected to said tubing string for measuring vibrations transmitted along said tubing string and for generating signals related to said vibrations; and means for receiving said signals related to said vibrations representing information transmitted between said first and second points along said tubing string as oscillatory vibrations.

4. A system for transmitting signals along an elongated tubing string between first and second spaced apart points on said tubing string, said system comprising:

an elongated tubing string supported by support means;

vibrator means interposed in said tubing string for generating vibrations for transmission along said tubing string between said first and second points; said vibrator means comprising at least two unbalanced rotor members connected to motor means and operable to be driven at selected speeds and in selected phase relationship to each other for generating torsional vibrations in said tubing string at selected frequencies;

means for exciting said vibrator means to produce said torsional vibrations for propagation along said tubing string between said first and second points;

means connected to said tubing string for measuring torsional vibrations transmitted along said tubing string and for generating signals related to said torsional vibrations; and means for receiving said signals related to said torsional vibrations representing information transmitted between said first and second points along said tubing string as torsional vibrations.

5. The system set forth in claim 2 wherein:

said sub includes passage means therethrough for conducting wellbore fluids through said stem.

6. The system set forth in claim 1 or 2 wherein:

said means for sensing said vibrations includes accelerometer means connected to said stem and responsive to said vibrations for transmitting a signal related to the frequency of said vibrations.

7. The system set forth in claim 6 wherein:

said stem includes a sub connected thereto, said sub including a first pair of accelerometers mounted thereon and operable to sense torsional vibrations in said stem.

8. The system set forth in claim 7 wherein:

said sub includes a second pair of accelerometers mounted thereon and spaced one from the other in such a way as to detect bending vibrations in said stem.

9. The system set forth in claim 1 or 2 wherein:

said means for sensing vibrations in said stem comprises strain gauge means disposed on said stem and operable to sense a selected one of axial and torsional vibrations along the surface of said stem.

10. The system set forth in claim 3 or 4 wherein:

said means for measuring said vibrations includes accelerometer means connected to said tubing string and responsive to said vibrations for transmitting a signal related to at least one of the frequency and amplitude of said vibrations.

11. The system set forth in claim 10 wherein:

said means for sensing said vibrations comprises a first pair of accelerometers connected to said tubing string and spaced apart in such a way as to be operable to sense torsional vibrations in said tubing string.

12. The system set forth in claim 10 wherein:

said means for sensing said vibrations comprises a pair of accelerometers connected to said tubing string and spaced apart in such a way as to be operable to sense bending vibrations in said tubing string.

* * * * *